US010184654B1

(12) United States Patent
Chen

(10) Patent No.: US 10,184,654 B1
(45) Date of Patent: Jan. 22, 2019

(54) LIGHTED DECORATIVE SCULPTURE

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/937,752

(22) Filed: Mar. 27, 2018

Related U.S. Application Data

(60) Provisional application No. 62/477,159, filed on Mar. 27, 2017.

(51) Int. Cl.

| | |
|---|---|
| ***F21S 4/26*** | (2016.01) |
| ***F21V 23/00*** | (2015.01) |
| ***F21V 23/06*** | (2006.01) |
| ***F21V 33/00*** | (2006.01) |
| ***F21W 121/00*** | (2006.01) |
| ***F21Y 115/10*** | (2016.01) |

(52) U.S. Cl.
CPC ..... *F21V 33/0028* (2013.01); *F21S 4/26* (2016.01); *F21V 23/002* (2013.01); *F21V 23/06* (2013.01); *F21W 2121/00* (2013.01); *F21Y 2115/10* (2016.08)

(58) Field of Classification Search
CPC ..... F21S 4/10; F21S 4/15; F21S 4/22; F21S 4/26; F21W 2121/00; F21W 2121/006
See application file for complete search history.

(56) References Cited

U.S. PATENT DOCUMENTS

| | | | |
|---|---|---|---|
| 4,761,720 | A | 8/1988 | Solow |
| 4,812,956 | A | 3/1989 | Chen |
| 6,086,221 | A | 7/2000 | Wu |
| 6,582,094 | B2 | 6/2003 | Liu |
| 6,758,001 | B1 | 7/2004 | Su |
| 6,769,954 | B2 | 8/2004 | Su |
| 6,914,194 | B2 | 7/2005 | Fan |
| 7,661,847 | B2 | 2/2010 | Wang |
| D623,084 | S | 9/2010 | Chen et al. |
| 7,926,978 | B2 | 4/2011 | Tsai |
| 8,397,381 | B2 | 3/2013 | Tsai |
| 2003/0063463 | A1 | 4/2003 | Sloan et al. |
| 2004/0246718 | A1 | 12/2004 | Fan |

(Continued)

*Primary Examiner* — Alexander K Garlen
(74) *Attorney, Agent, or Firm* — Christensen, Fonder, Dardi & Herbert PLLC

(57) ABSTRACT

A lighted decorative sculpture. The sculpture is wrapped in light strings having translucent electrical insulation that clads electrical conductors of the light string, so that some of the light emitted by the lighting elements propagates axially along the light string before being scattered, refracted, or reflected radially away from the light string. In this way, the light strings so arranged effectively function as their own reflector, eliminating the need for wrapping the sculpture in an outer layer prior to mounting the light strings. The ability to view between the wrapped light strings and into the illuminated hollow of the sculpture also produces a unique lighting effect, giving the sculpture an overall translucent appearance. Various embodiments include a plurality of light strings that stem from the main power circuit, with LED lighting elements. The number of lighting elements per light string may be limited to prevent dimming of the lighting elements.

12 Claims, 11 Drawing Sheets

(56) References Cited

U.S. PATENT DOCUMENTS

| | | | | |
|---|---|---|---|---|
| 2005/0047136 | A1* | 3/2005 | Fan | B44C 5/00 362/235 |
| 2006/0158878 | A1* | 7/2006 | Howell | F21S 4/10 362/223 |
| 2006/0221609 | A1 | 10/2006 | Ryan, Jr. | |
| 2010/0001664 | A1* | 1/2010 | Shih | H05B 33/0803 315/313 |
| 2016/0341408 | A1 | 11/2016 | Altamura | |
| 2017/0328527 | A1* | 11/2017 | Yang | F21S 4/26 |

* cited by examiner 92
94
80
88
92
94
126
88
122
87
124
106
114
116
118
112
114
112
116
104
118
110
84
102
108 z
θ
r
85
92
80
92
88
106
112
104
112
84
110
87,124
102
108
128

92
80
92
116
84
112
114
114
116
112
128
154
150
152
144
154
156
156
148
140
72
142
146
70 z
θ
r
85
92
80
92
112
154
112
114
156
116
154
156
116
128
148
140
72
142
146
70

LIGHTED DECORATIVE SCULPTURE

PRIORITY CLAIM

This application claims the benefit of U.S. Provisional Patent Application No. 62/477,159, filed Mar. 27, 2017, which is incorporated herein in its entirety.

FIELD OF THE DISCLOSURE

The present disclosure relates to decorative lighting systems. More specifically, the present disclosure relates to lighted decorative sculptures.

BACKGROUND OF THE DISCLOSURE

Traditional lighted decorative sculptures typically include components that are mechanically affixed to each other to represent a figure in three dimensions, such as a reindeer, Santa Clause, snowman, stable, or similar holiday figure. To enhance the lighting effect, the sculpture is often wrapped with an outer layer of fabric or other wrapping prior to affixing lights to the outside of the assembly. The outer layer serves to reflect light away from the sculpture that would otherwise be directed inward toward the core of the lighted sculpture. In this way, more of the light is directed outward, to brighten the appearance of the sculpture.

Often, these sculptures are situated outdoors, and exposed to inclement weather. Light strings are attached to the sculptures to outline the sculpture for illumination in darkness. Traditional light strings typically include a set of insulated wires and incandescent bulbs. The insulated wires typically comprise a pair of insulated multi-strand conductors, for example, a pair of 22 AWG insulated wires, each multi-strand conductor having sixteen twisted copper strands, connected to each bulb. The gauge of the wire must be sufficient to withstand the rigors of shipping, handling, and storage, as well as the extremes of outdoor weather, such as snow, rain, and a substantially wide range of temperatures.

More recently, and in an effort to increase energy efficiency and reliability, manufacturers have begun using light-emitting diodes (LEDs) rather than incandescent bulbs. Indeed, lighted decorative sculptures having light strings with LEDs rather than incandescent bulbs are well known. Such known lighted decorative sculptures often simply replace the incandescent bulbs with similar bulb or lamp assemblies that use LED "bulbs," utilizing the same insulated, multi-strand conductor wiring as the incandescent-bulb-based light strings, and utilizing the same techniques of affixing the light strings to the sculpture. In some cases, the lower current requirements of the LEDs may allow the use of smaller diameter conductors or fewer conductor strands, for example, allowing the use of 25 AWG wire, for example, instead of 22 AWG wire.

While such a technique maintains the look and feel of a traditional lighted decorative sculptures having traditional light strings, with the growing popularity of more and more lights on a decorative sculpture, such sculptures, even with LED technology, include an enormous length of electrically insulated wire that remains visible on the components of the lighted decorative sculpture, thereby diminishing the perceived attractiveness of the sculpture. Furthermore, shipping, handling, and storage considerations require the use of relatively strong, traditional wires having conductor thicknesses that may be oversized given the low current draw of LEDs.

A simple and inexpensive solution that takes full advantage of the low-current requirements of LED lamps while maintaining the integrity of the lighting system would be welcomed.

SUMMARY OF THE DISCLOSURE

In various embodiments of the disclosure, the lighting elements are arranged to illuminate along the axis of the light string, so that the lighting elements present a more uniform luminosity when viewed from the side of the string, regardless of the rotational angle from which the string is viewed. Also, in some embodiments, electrical insulation that dads electrical conductors of the light string is translucent, so that some of the light emitted by the lighting elements propagates axially along the light string before being scattered, refracted, or reflected radially away from the light string. In this way, the light strings so arranged effectively function as their own reflector, eliminating the need for wrapping the sculpture in an outer layer prior to mounting the light string. The ability to view between the wrapped light strings and into the illuminated hollow of the sculpture also produces a unique lighting effect.

Various embodiments of the disclosure include a trunk or main power circuit that extends through the lighted decorative sculpture, with a plurality of light strings that stem from the main power circuit. In some embodiments, the lighting elements comprise light emitting diodes (LEDs) and the number of lighting elements per light string is limited, for example, to 50 lighting elements or less to prevent dimming of the lighting elements. By configuring the lighting system in this way, the number of lights can be significantly increased without encountering dimming of the lighting elements. For example, conventional lighted sculptures can typically accommodate 100 to 250 light elements. By incorporating the combination of LEDs of limited number per string, while providing a substantially greater number of light strings that stem from the main power circuit, embodiments of the lighted decorative sculpture of the present disclosure can accommodate up to 1500 light elements—an increase of six-fold or more over conventional light structures.

Structurally, a lighted decorative sculpture is disclosed, comprising a plurality of detachable sections, each including an open framework that defines a component of the lighted decorative sculpture, and each including a plurality of light strings, each defining a central axis and including a plurality of lighting elements, each extending from within the open framework to outside of the open framework and being wrapped around an exterior portion of the open framework to form a wrapping, the wrapping and open framework defining a hollow. A main power circuit that passes within the hollow of each of the plurality of detachable sections, each of the plurality of light strings being electrically connected to the main power circuit. In some embodiments, at least one member of the open framework of each detachable section includes a plurality of protrusions that extend into the hollow, the plurality of light strings being moored to the plurality of protrusions. The plurality of light strings may be moored to the plurality of protrusions by wrapping the plurality of light strings around the member at the plurality of protrusions. In some embodiments, the plurality of protrusions are formed as loops, the loops extending from the at least one member of the open framework. In other embodiments, the at least one member is formed to define the loops. In some embodiments, the open framework of at least one of the plurality of detachable sections is two-dimensional.

The lighting elements of each of the plurality of light strings may be light emitting diodes (LEDs). The light strings may include a pair of conductors that are wired to the plurality of LEDs in a parallel circuit. Each conductor of the pair of conductors may be single strand wires. In some embodiments, a number of the LEDs of the plurality of lighting elements for each of the plurality of light strings is in a range of 35 to 60 inclusive; in some embodiments, the number of the LEDs of the plurality of lighting elements for each of the plurality of light strings is in a range of 40 to 50 inclusive.

In some embodiments, the main power circuit includes excess length that enables the plurality of detachable sections to be detached and arranged for storage or shipping. The excess length may be disposed within the lighted decorative sculpture when the plurality of detachable sections are attached. The main power circuit may also include at least two sections that are coupled together by a connector for disconnecting the at least two sections when the detachable sections of the lighted decorative sculpture are detached.

In various embodiments of the disclosure, the plurality of lighting elements of each of the plurality of light strings are oriented to direct light emitted from each of the plurality of lighting elements in a direction substantially parallel to the central axis. Each of the plurality of light strings may include conductors that are connected to and extend between the plurality of lighting elements, the light conductors being clad in electrical insulation that is translucent for diffracting light emitted from the plurality of lighting elements. Each of the plurality of the light strings may be connected to the main power circuit with a connector. In some embodiments, the lighted decorative sculpture does not include a light string that branches from another light string.

The plurality of light strings for each of the plurality of detachable sections each include electrical conductors of a first gauge and the main power circuit includes electrical conductors of a second gauge, the first gauge being higher than the second gauge. The first gauge may be in a range of 24 AWG to 30 AWG inclusive, and the second gauge may be in a range of 18 AWG to 22 AWG inclusive. In some embodiments, each of the plurality of light strings has a length in a range of 50 cm to 150 cm inclusive; in some embodiments, each of the plurality of light strings has a length in a range of 75 cm to 125 cm inclusive.

DETAILED DESCRIPTION OF THE FIGURES

Figure 1:
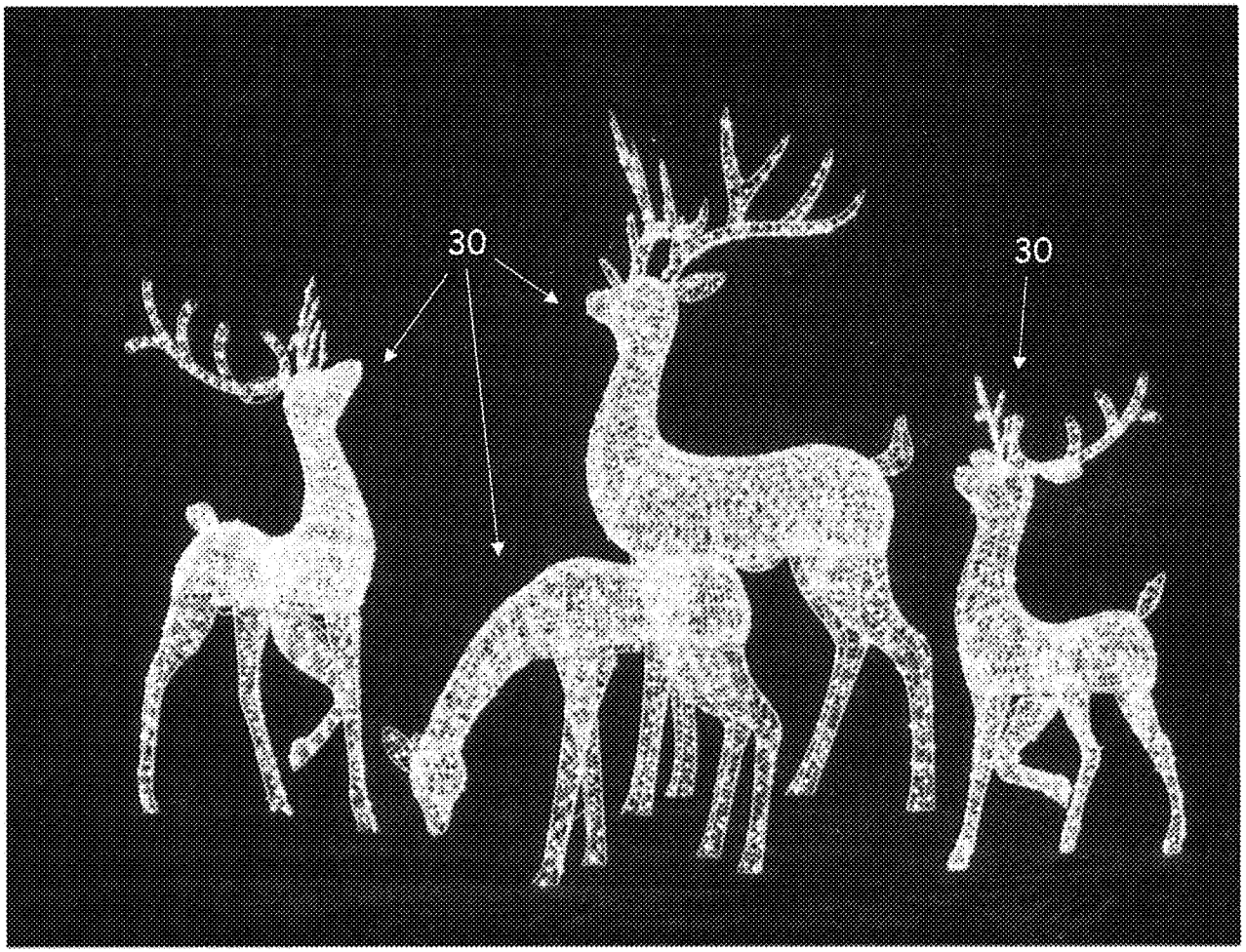
FIG. 1 is an illustration of fully assembly and energized lighted decorative sculptures illuminating a dark setting according to embodiments of the disclosure.
Figure 2:
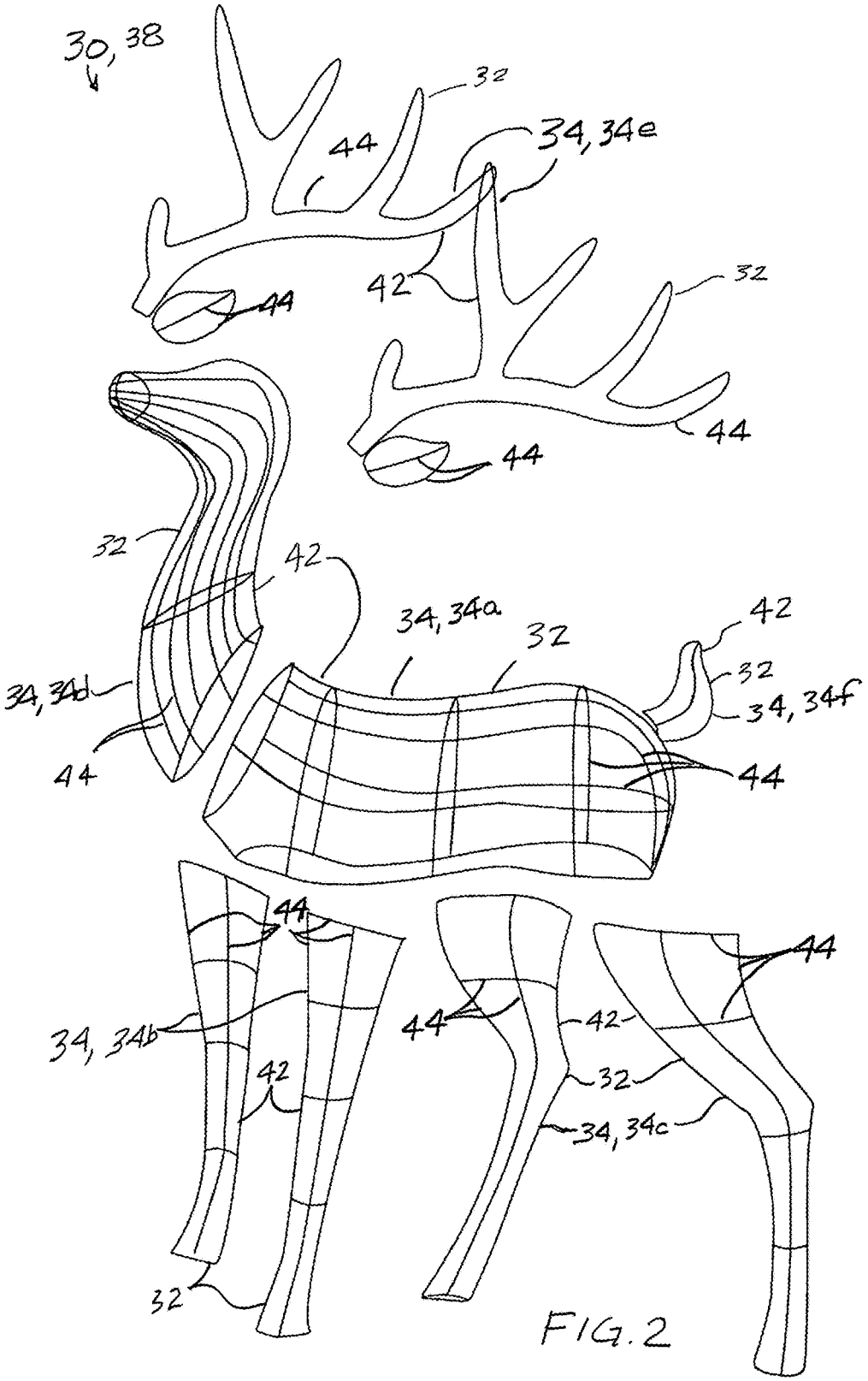
FIG. 2 is an exploded view of the of an open framework of the components of a lighted decorative sculpture according to an embodiment of the disclosure.

Referring to FIGS. 1 through 5, a lighted decorative sculpture 30 having detachable sections 32 is depicted in various stages of manufacturing according to an embodiment of the disclosure. Each of the detachable sections 32 represents a component 34 of the image that the lighted decorative sculpture 30 emulates. The particular lighted decorative sculpture 30 depicted is a reindeer sculpture 38, having a torso component 34*a*, front leg components 34*b*, back leg components 34*c*, a head and neck component 34*d*, ear and antler components 34*e*, and a tail component 34*f*. Herein, the components are referred to collectively or generically by the reference character 34, and specifically by the reference character 34 followed by a letter suffix (e.g., "front leg component 34*b*").

Each of the components is defined by an open framework 42 having one or more members 44. The open framework 42 may define components that are three-dimensional (e.g., the torso component 34*a* and the head and neck component 34*d*). In some embodiments, the open framework 42 may define components that are three-dimensional may include components 34 that are two dimensional or planar (e.g., the antlers of the ear and antler components 34*e*, and the tail component 34*f*).

Figure 3:
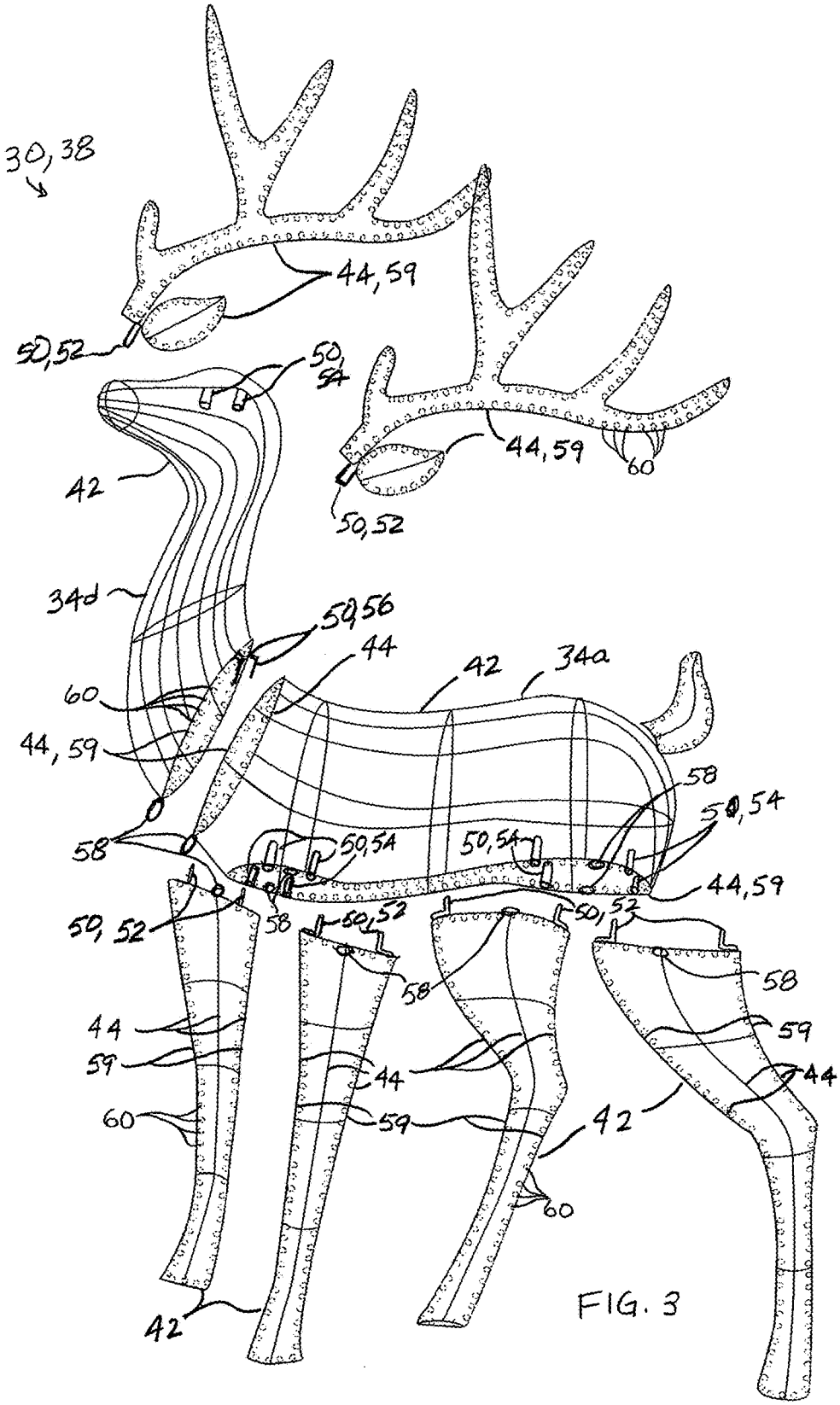
FIG. 3 is an exploded view of the lighted decorative sculpture of FIG. 2 with anchor members and mechanical mounting fixtures according to an embodiment of the disclosure.
Figure 3A:
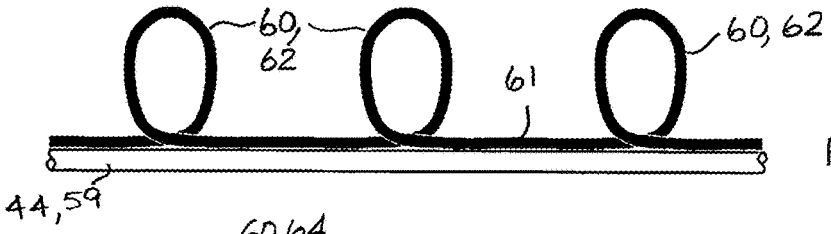
FIGS. 3A through 3G are partial views of alternative configurations for protrusions of the anchor members according to embodiments of the disclosure.
Figure 3B:
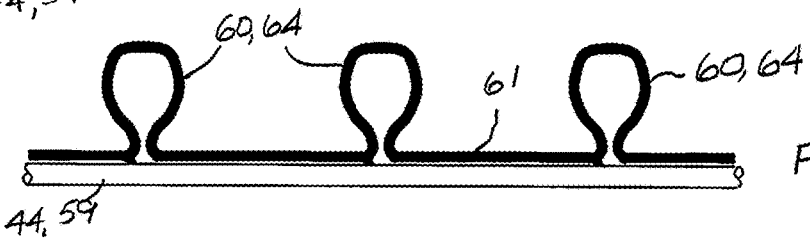
Figure 3C:
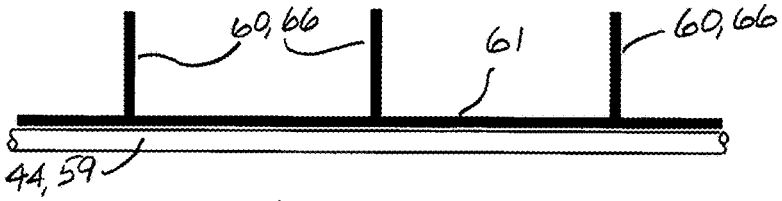
Figure 3D:
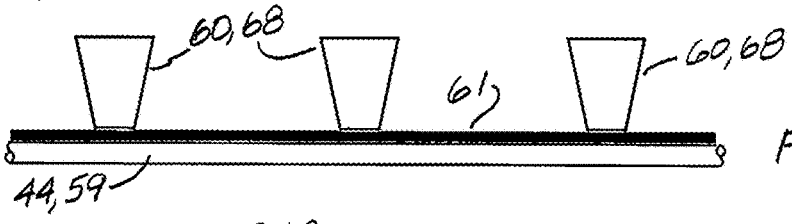

The detachable sections 32 may be mechanically coupled together in various ways. For example, the open frameworks 42 may include mechanical mounting fixtures 50, for example pins 52 that mount within sockets 54, as depicted in FIG. 3. Other structures may be utilized for the mounting fixtures 50, such as hooks 56 that are hooked onto member (s) 44 of the framework 42 to be joined (e.g. at FIG. 3, for joining the head and neck component 34*d* to one of the members 44 of the torso 34*a*). In some embodiments, the components 34 to be joined include opposed grapnels 58, such as eyelets (depicted) or hooks that are in substantial alignment with each other when the components are joined (FIG. 5B). The grapnels 58 provide structure that may be tied together, for example with a twist tie 57 (depicted), string, wire, or clip. The open frameworks 42 and mounting fixtures 50 may be fabricated from a metal material, though other materials may be utilized, including plastic.

Functionally, the mounting structures 50 secure the detachable sections 32 to each other in a proper orientation. In some embodiments, the mounting fixtures 50 are keyed, for example, by virtue of their location on the respective open framework 42 in three-dimensional space, or, for example, by the shape of the pins 52 and sockets 54 (e.g., square or rectangular), so that the respective detachable sections 32 being joined can only be mounted to each other in the proper rotational orientation. Tying the components 34 together at the grapnels 58 secures the detachable sections 32 together regardless of orientation, and also holds the lighted decorative sculpture 30 together against external forces, such as wind and gravity.

It is understood that the way the reindeer sculpture 38 is sectioned (e.g., number of components, the way the sculpture is divided) is non-limiting. It is further understood that, generally, the lighted decorative sculpture 30 may define a sculpture other than the reindeer sculpture 38, for example, a snow man, Santa Clause, stable, or other figure that includes detachable components. Such sculptures may include more or fewer detachable sections than depicted.

Figure 3E:
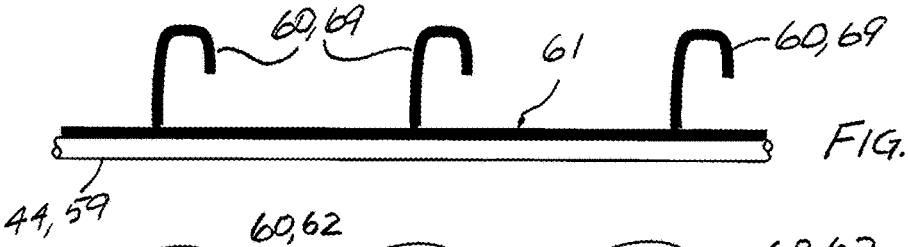
Figure 3F:
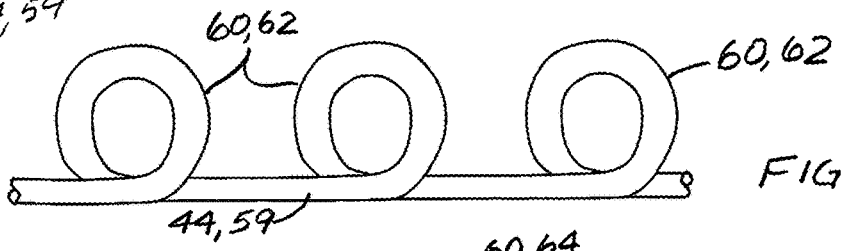
Figure 3G:
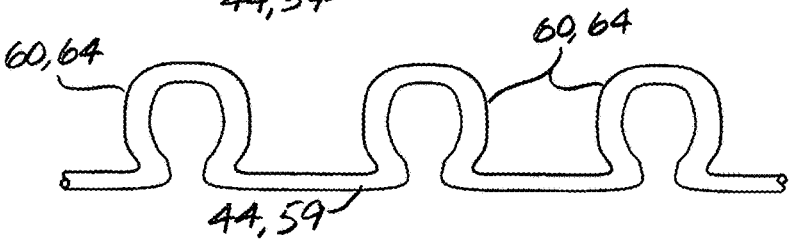

Referring to FIGS. 3A through 3G, example constructions of anchor members 59 having protrusions 60 are depicted in embodiments of the disclosure. In some embodiments, at least one of the members 44 of the open framework 42 of each detachable section 32 is an anchor member 59 that includes a plurality of protrusions 60. The protrusions 60 extend inward, toward an interior of the open frame work 42 (FIG. 3). In some embodiments, the plurality of protrusions 60 are formed separately to extend from a rod 61 and the rod 61 mounted to the anchor member 59, for example by a welding or bonding operation. Examples of such separately formed protrusions 60 include closed or crossover loops 62 (FIG. 3A), open loops 64 (FIG. 3B), straight protrusions 66 (FIG. 3C), tabs 68 (FIG. 3D) and hooks 69 (FIG. 3E). In other embodiments, the anchor member 59 itself is formed to define the protrusions 60, e.g., to form the closed loops 62 (FIG. 3F) or the open loops 64 (FIG. 3G).

Figure 4:
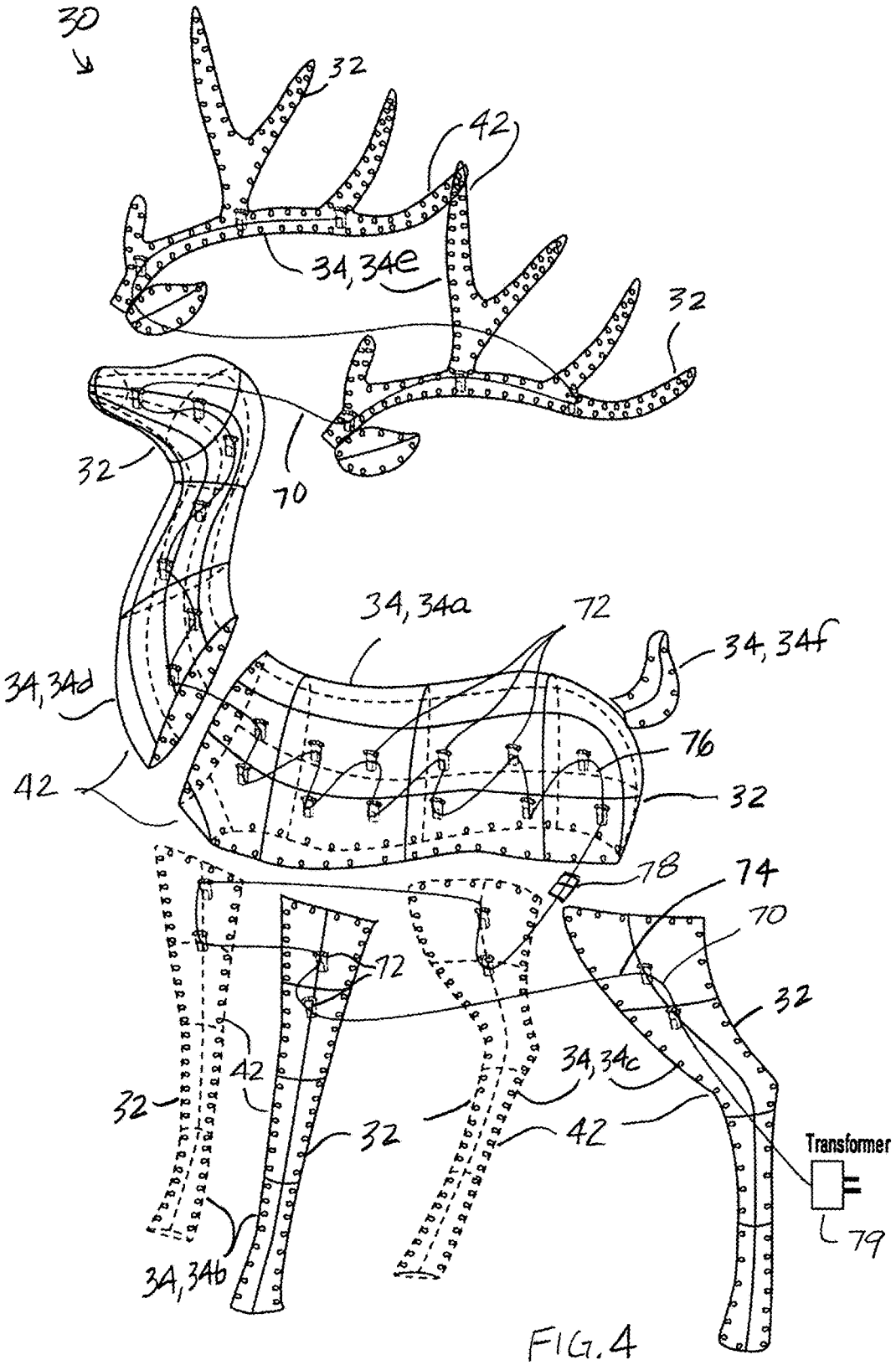
FIG. 4 is an exploded view of the lighted decorative sculpture of FIG. 2 with a main power circuit according to an embodiment of the disclosure.

A main power circuit 70 is routed through the components 34 of the decorative sculpture 30 (FIG. 4). The main power circuit 70 includes receptacles 72 for connection of light strings, described below. The main power circuit 70 may be coupled to the inside if the open framework 42, for example with cable ties or clips. Techniques for coupling of the main power circuit 70 to the open framework 42 are described and depicted, for example, at U.S. Provisional Patent Application No. 62/441,900 to Chen, filed Jan. 3, 2017, now U.S. Utility application Ser. No. 15/680,887 and owned by the assignee of the present application, the contents of which are hereby incorporated by reference herein except for patent claims and express definitions contained therein.

In some embodiments, the main power circuit 70 includes excess length that is not anchored to the open framework 42, and that enables the plurality of detachable sections 32 to be mechanically detached while maintaining electrical connection. The plurality of detachable sections 32 may then be detached and arranged in a compact manner for storage or shipping. By this arrangement, the lighted decorative sculpture 30 can be mechanically decoupled while the electrical circuits remain intact, for ready reassembly. In some embodiments, when the lighted decorative sculpture 30 is assembled and the plurality of detachable sections are attached, the excess length is disposed within the lighted decorative sculpture 30. In some embodiments, the main power circuit 70 includes at least two sections 74 and 76 that are coupled together by a connector 78 for disconnecting the at least two sections 74 and 76 when the detachable sections of the lighted decorative sculpture 30 are detached.

The main power circuit 70 may also include a transformer or power converter 79 that reduces high AC voltage to a low DC voltage. In some non-limiting embodiments, the transformer 79 accepts an AC input voltage in a range from 100 VAC to 240 VAC at 0.35 amperes and outputs a DC voltage that is nominally 9 VDC and approximately 2 amperes. The transformer 79 may also be packaged with a controller (not depicted) that includes a microprocessor, circuitry, and non-volatile memory to selectively control the power. The controller may put out a signal that includes an encoded carrier that outputs an encoded address. The lighting elements 92 (described below) may be "smart lights" that include an integrated switch or processor (not depicted) for decoding the encoded addresses sent by the controller, and receives power from the power circuit 70 only when the address received is specific to the respective lighting element. In this way, the light elements 92 may be controlled to change colors, fade in and out, flash, or twinkle (i.e., some lights being steady while others flash), as well as the speed or time frame for the lighting operation. Further information regarding controller interaction with lighting elements is provided at U.S. Provisional Patent Application No. 62/466,547 to Chen, filed Mar. 3, 2017, now utility application Ser. No. 15/911,809, both owned by the assignee of the present application, the contents of which are hereby incorporated by reference in their entireties herein except for patent claims and express definitions contained therein.

Figure 5:
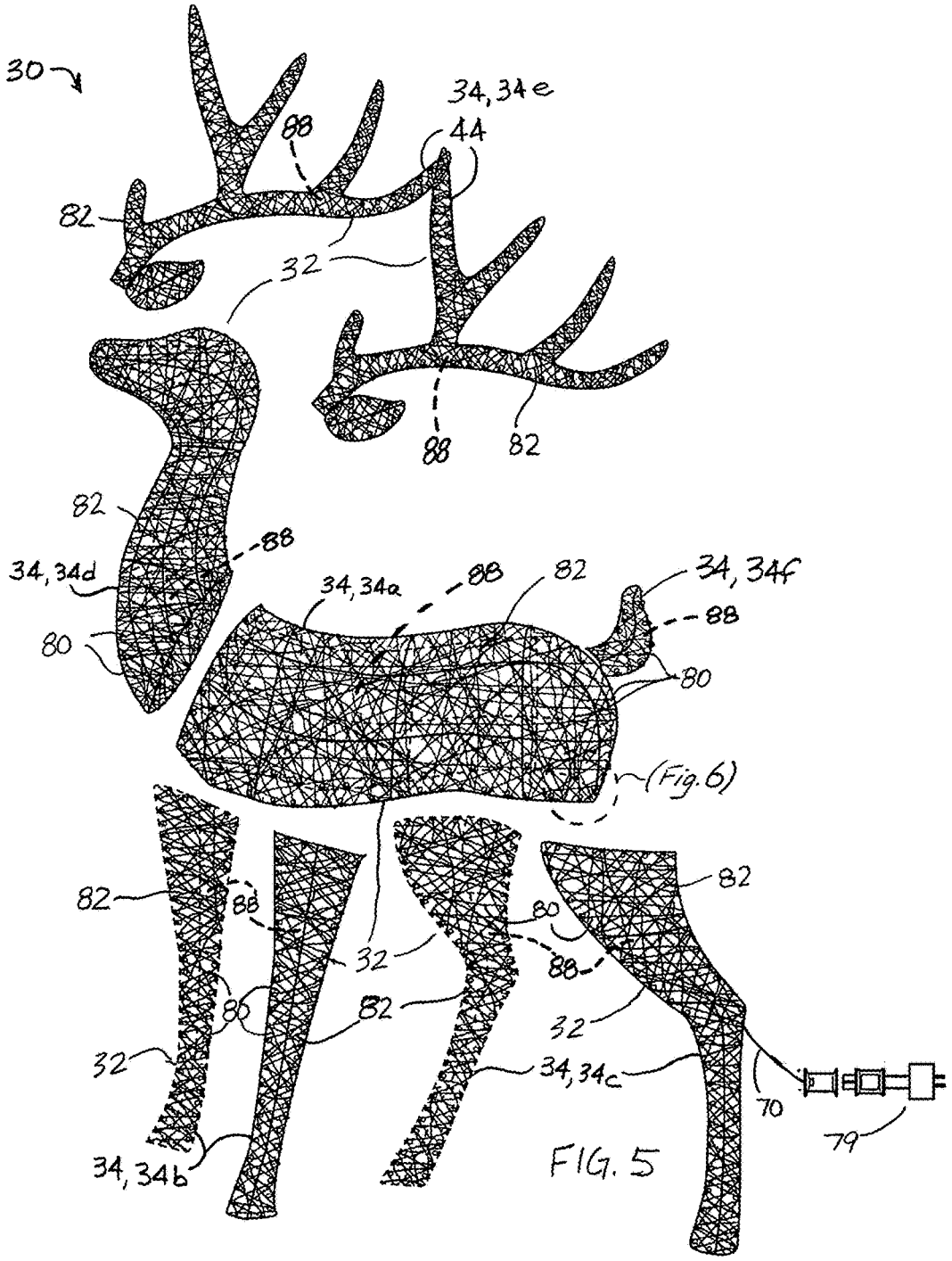
FIG. 5 is an exploded view of the lighted decorative sculpture of FIG. 4 wrapped in light strings according to an embodiment of the disclosure.
Figure 5B:
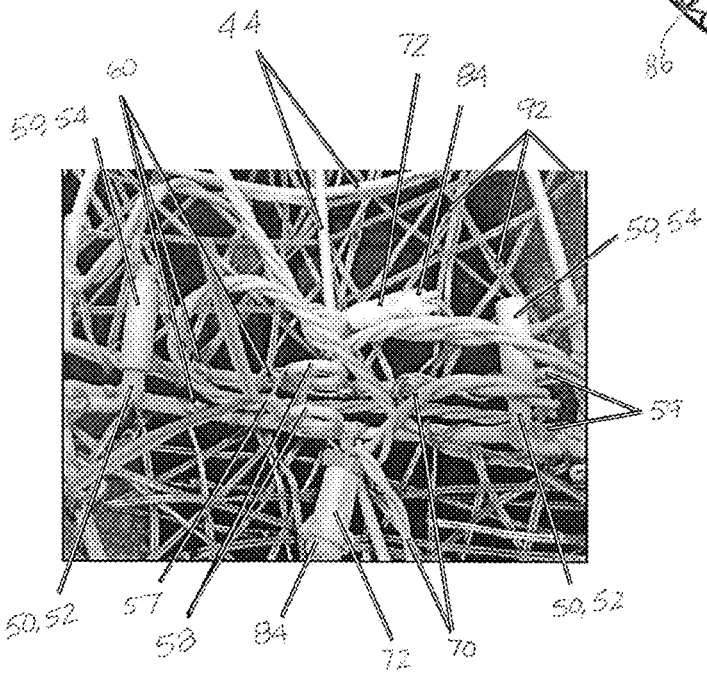
FIG. 5B is a partial view of a fully assembled lighted decorative sculpture, depicting the coupling of mechanical mounting fixtures according to an embodiment of the disclosure.
Figure 5A:
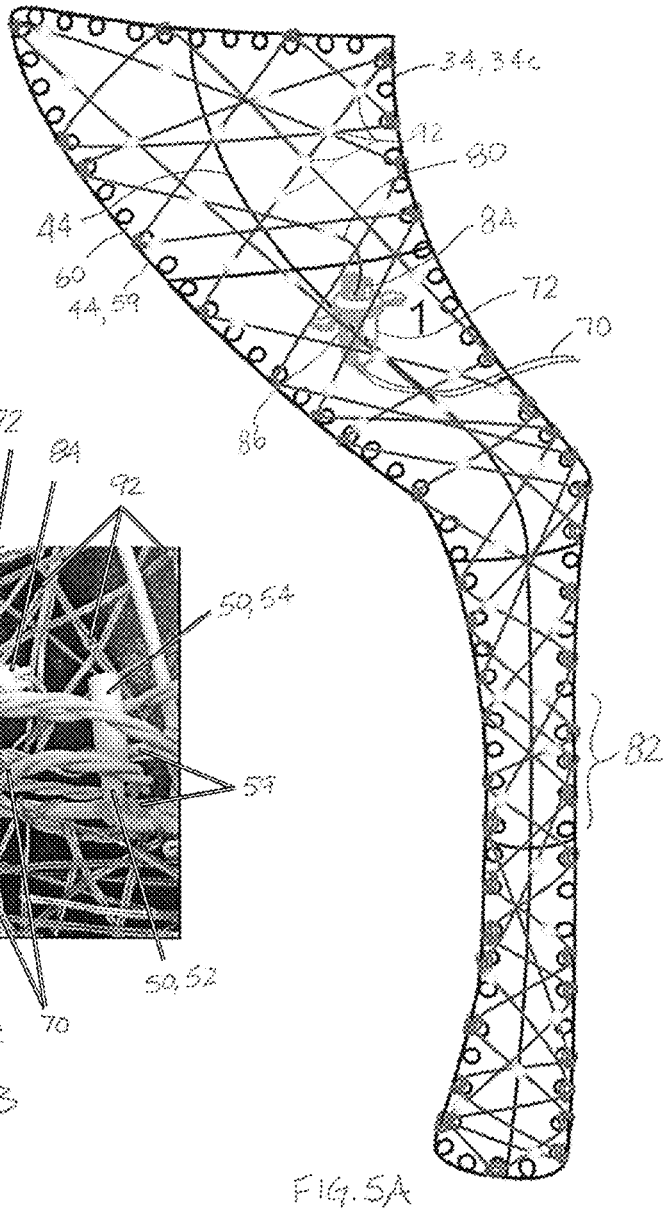
FIG. 5A is a plan view of a wrapped component of FIG. 5 in isolation according to an embodiment of the disclosure.

Each of the detachable sections 32 further includes a plurality of light strings 80 that are wrapped around an exterior of the open framework 42 to form a wrapping 82 about each detachable section 32 (FIG. 5). In the depicted embodiment, each of the plurality of light strings 80 includes a plug 84 that mates with a respective one of the receptacles 72 to form a connector 86 for electrical connection to the power circuit 70. The open framework 42 and wrapping 82 cooperate to define a hollow 88 within each of the detachable sections 32. For substantially planar components 34 (e.g., the antlers of the ear and antler components 34*e*, and the tail component 34*f*), the hollow 88 is defined by the thickness of member(s) 44 of the component 34 and the separation of the light string(s) 80 that are wrapped around and on both sides of the component two-dimensional component 34. In some embodiments, a given light string 80 is limited to being wrapped around a single component 34.

Figure 6:
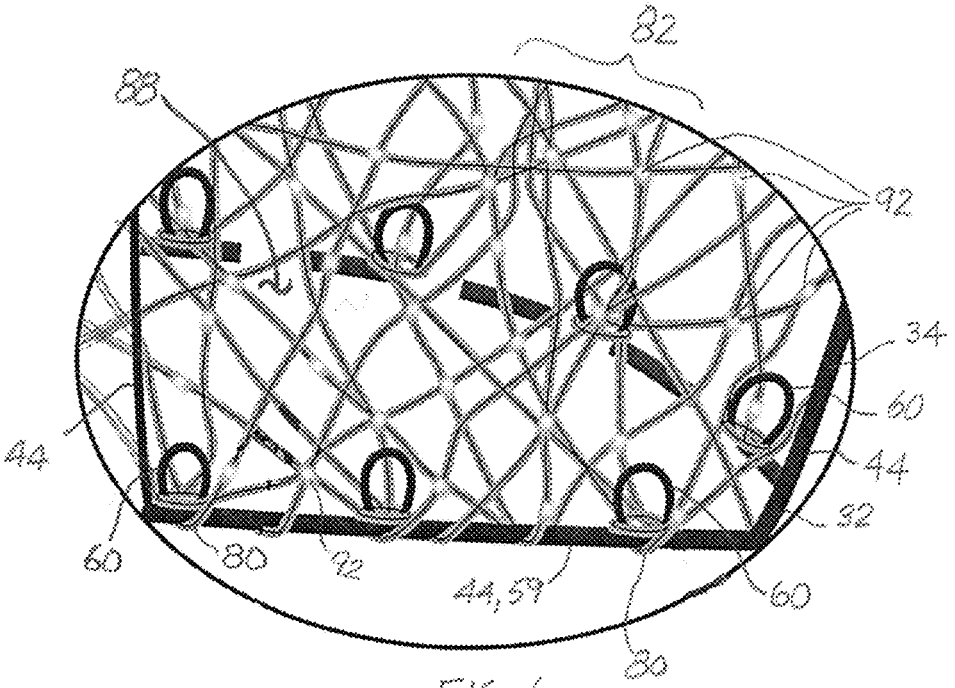
FIG. 6 is an enlarged, partial view of FIG. 5 according to an embodiment of the disclosure.
Figure 6A:
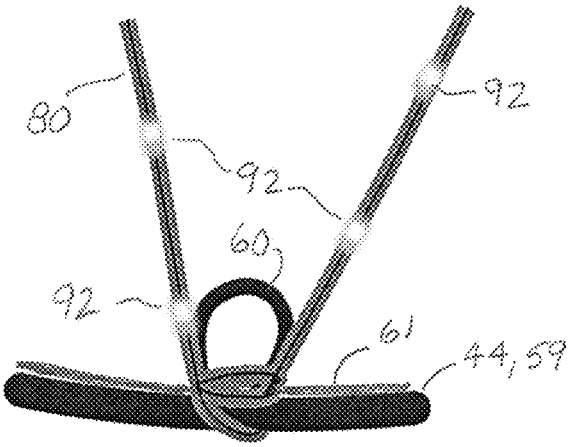
FIGS. 6A and 6B are enlarged, isolated views of protrusions wrapped with light strings according to an embodiment of the disclosure.
Figure 6B:
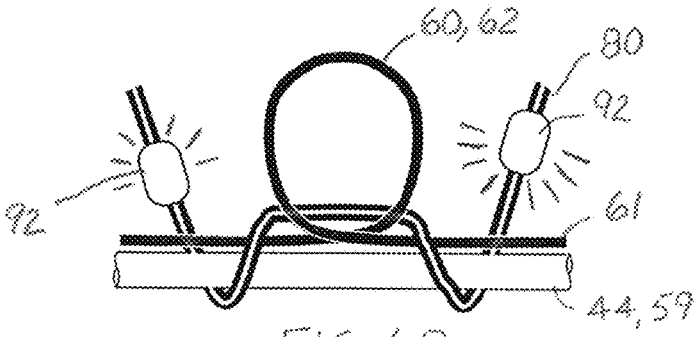

Referring to FIGS. 6, 6A, and 6B, assembly of the plurality of light strings 80 to the detachable sections 32 are depicted in embodiments of the disclosure. The assembly of FIGS. 6 and 6A depict an embodiment where the light strings 80 are wrapped at least partially around several of the protrusions 60. In this embodiment, the light string 80 is wrapped completely around the base of a protrusion 60 and around the anchor member 59. In FIG. 6B, an alternative routing for the light strings 80 is depicted, where the light string 80 is routed around the anchor member 59, back behind the protrusion 60, and again around the anchor member 59.

Functionally, wrapping the light strings 80 as depicted in FIGS. 6A and 6B effectively moor the light strings 80 to the open framework 42. More specifically, the plurality of light strings 80 are moored to the plurality of protrusions 60 and the anchor member 59 proximate the protrusion 60. The mooring secures the wrapping 82 in place about the respective component 34. By limiting the wrapping of a given light string 80 to a single component 34, the various detachable sections 32 can be separated for shipping or storage without having to unravel any of the light strings 80 from the open framework 42.

Figure 7:
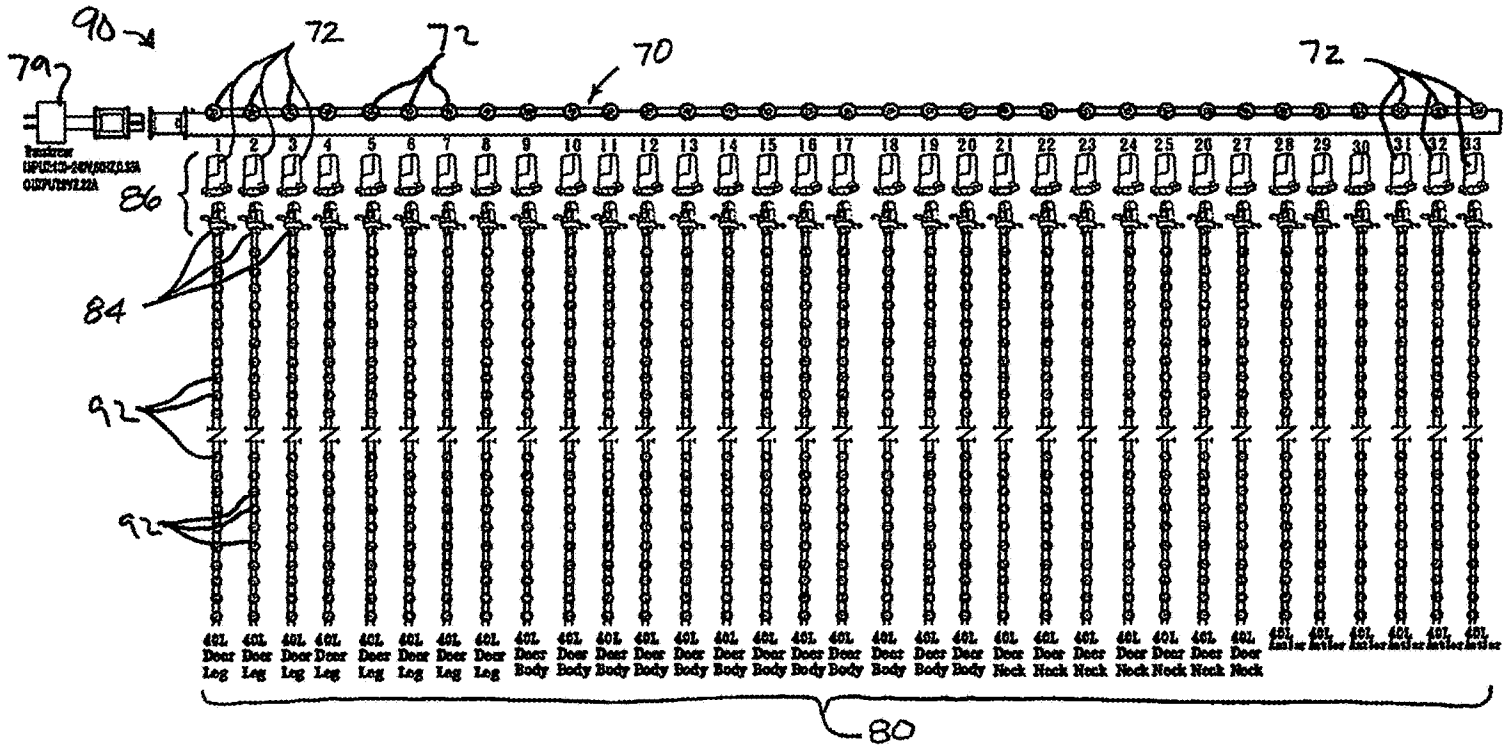
FIG. 7 is a schematic layout of the main power circuit of FIG. 4 according to an embodiment of the disclosure.

Referring to FIG. 7, a schematic layout 90 of the main power circuit 70 and the plurality of light strings 80 is depicted in an embodiment of the disclosure. For the schematic layout 90, none of the light strings 80 branch from another light string 80; rather, all of the plurality of light strings 80 stem directly from the main power circuit 70. The layout 90 depicts the light strings 80 as being connected to the main power circuit 70 through connectors 86 having plugs 84 that detachably connect to the receptacles 72. The layout 90 numbers each of the light strings 80 as 1 through 33. The layout also identifies each of the light strings 80 as being assigned to a component 34 of the lighted decorative sculpture 30: the light strings 80 that are numbered 1 through 8 are wrapped around the legs (i.e., front and back leg components 34*b* and 34*c*); the light strings 80 numbered 9 through 20 are wrapped around the body (i.e., torso and tail components 34*a* and 34*f*); the light strings 80 numbered 21 through 27 are wrapped around the neck (i.e., the head and neck component 34*d*); and the light strings numbered 28 through 33 are wrapped around the antlers (i.e., the ear and antler components 34*e*). Also for the schematic layout 90, each of the light strings 80 has 40 lighting elements 92.

As depicted, each light string 80 includes lighting elements 92 that are all electrically connected to one another to form a parallel light string 80. In this embodiment, parallel light strings 80 numbered 1-11 are electrically connected to one another in parallel (a first group of light strings 80); light stings 80 numbered 12-22 are electrically connected to one another in parallel (a second group of light strings 80); and light stings 80 numbered 23-33 are electrically connected to one another in parallel (a third group of light strings 80). The first, second, and third groups of light strings 80 are electrically connected to one another in a series configuration, as depicted. In the embodiment depicted, transformer 79 provides power to the light strings 80, and in an embodiment, is a 9 VDC output transformer providing 3 VDC to each group of light strings 80 (recalling that each light string group is electrically connected in series to each other). Further, because each lighting element 92 per light string 80 is electrically connected in parallel, each lighting element 92 receives 3 VDC.

It will be understood that in other embodiments, lighting elements 92 within a particular light string 80 may be electrically connected in a parallel-series configuration, rather than parallel. Further although only three groups of light strings 80 are depicted, more or fewer groups of light strings 80 may be utilized for larger or smaller sculptures, or to accommodate different transformer 92 outputs, e.g., four groups of light strings 80 at 3 VDC for a 12 VDC transformer 72. The number of light strings 80 in a group may also vary depending on the size of a particular lighted sculpture, or desired light density. In an embodiment wherein all lighting elements 92 are electrically connected in parallel, and as depicted, the number or quantity of lighting elements 92 per light strings may be limited to a predetermined number, which in one embodiment is 40 lighting elements 92. As described further below, limiting the number of lighting elements 92 in such a manner minimizes the voltage drop from a point on the light string 80 near the plug 72, i.e., the "beginning" of the light string, as compared to a point on the light string 80 furthest from the plug 72, and at the last lighting element 92, or "end" of the light string, due to cumulative resistance in the wires and wire connections over the length of the light string. For example, although theoretically a light string 80 with all parallel-connected lighting elements would be expected to all receive 3 VDC across the conductors, those lighting elements furthest from plug 92 and the power source, may receive less than 3 VDC, which can result in a variation in brightness along the length of the light string 80. Such a situation could result in lighting elements 92 at an end of the light string being dimmer than those at the beginning of the light string 80. By limiting the number of parallel-connected lighting elements 92 in a light string 80, such a variation in brightness can be avoided. For very small LEDs with relatively low light output, the inventor has found that an embodiment having no more than 40 lighting elements per light string 80 avoids brightness variation, particularly when spacing between lighting elements 92 is 3 inches or less, and/or wire sizes are 25 AWG or less. In an embodiment, spacing between lighting elements 92 is uniform, and be in a range of 1 inch to 3 inches, inclusive; in another embodiment, spacing is uniform, and is in a range of 0.5 inches to 1.5 inches, inclusive; in other embodiments, other spacing may be used.

Figure 8:
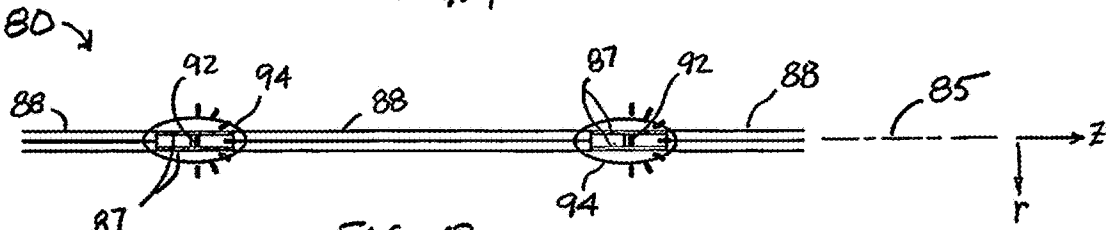
FIG. 8 is a partial view of a light string according to an embodiment of the disclosure.

Referring to FIG. 8, an example of the light string 80 is depicted in an embodiment of the disclosure. The light string 80 defines a central axis 85 about which a pair of electrical conductors 87 clad in electrical insulation 88 extends. Herein, it will be understood that "conductor" refers to an uninsulated wire, meaning just the conductive portion of an insulated wire, and that the conductor may comprise multiple conductive strands or a single conductive strand. Further, the term "wire" will be understood to generally mean "conductor" or only the conductive portion of an insulated wire. In an embodiment, and as depicted, each conductor comprises a continuous, unbroken conductor, rather than a series of connected conductor segments. In such an embodiment, the continuous, unbroken conductor may comprises a single-strand conductor, or may comprise a continuous unbroken conductor that comprises multiple strands of adjacent conductive strands. The terms "continuous" herein means that the conductor and/or its conductive strands are not interrupted or broken along their respective length(s). An example of a continuous conductor would include a conductor that comprises a single, unbroken conductive strand of approximately 40 inches in length; another example of a continuous conductor is one that comprises multiple, unbroken conductive strands of approximately 40 inches in length each wrapped about one another along their lengths to form a multi-strand continuous conductor. A conductor that is not continuous would be one comprising multiple segments of conductors that are connected to one another in an end-to-end fashion, such connection being made by soldering or via wire or conductor connectors. In an embodiment, each conductor 87 of a light string 80 comprises a continuous conductor, while power circuit 70 comprises non-continuous or segmented conductors. In the depicted embodiment, a plurality of lighting elements 92 are sourced by the electrical conductors 87, each of the lighting elements 92 being light emitting diodes (LEDs).

In some embodiments, the electrical conductors 87 are electrically connected to the plurality of LEDs 92 in a parallel circuit, with an anode of each LED electrically connected to a first electrical conductor 87 and a cathode of each LED electrically connected to a second electrical conductor 87. Each conductor of the pair of electrical conductors 87 may be a single-strand wire or conductor. In other embodiments, each conductor may comprise multiple strands, rather than a single strand.

In an embodiment, and as depicted (see also FIGS. 9A-10B), portions of electrical insulation 88 are removed from continuous conductors 87, such that the electrical insulation 88 defines lengthwise gaps in the vicinity of each lighting element 92. In an embodiment, and as depicted, electrical insulation 88 is completely removed about a circumference of conductors 87 thereby forming segments of electrical insulation 88 over continuous conductors 87.

In the depicted embodiment, the plurality of lighting elements 92 of the light string 80 are oriented to direct light emitted from each of the plurality of lighting elements in a direction substantially parallel to the central axis 85. The lighting elements 92 and the portions of the electrical conductors 87 to which the lighting elements 92 are mounted are encapsulated in a translucent potting 94, such as epoxy or an ultraviolet-activated adhesive.

Functionally, when electrical insulation 88 is partially or wholly translucent, light from the lighting element 92 enters the electrical insulation 88 and is scattered, refracted, or reflected off the electrical conductors 87 and the electrical insulation 88 as the light propagates at least partially axially (i.e., parallel to the central axis 85) along the electrical insulation 88 to create a unique lighting effect. Also, because the luminosity of the light emitted about the central axis 85 from the light strings 80 is substantially the same regardless of the angle from which the lighting elements 92 are viewed, there is no need to wrap the lighted decorative sculpture 30 with an outer layer to redirect light from lighting elements that would otherwise be imperfectly oriented. The light string 80 itself acts as a reflective layer, in addition to a refracting and scattering layer, to direct light away from the lighted decorative sculpture 30 in a substantially uniform manner. The construction and effect of the light string 80 with lighting elements 92 so arranged is described in U.S. Provisional Patent Application No. 62/466,547, now utility application Ser. No. 15/911,809, incorporated by reference above.

In some embodiments, the electrical insulation 88 is of a translucent material, for example a translucent polyvinylchloride material. In other embodiments, insulation 88 is opaque. When insulation 88 is opaque, light directed axially through translucent potting 94 reflects off of insulation 88, directing light transversely to the conductors and the light string axis.

When translucent, the material of the electrical insulation 88 of different light strings 80 may be hued with different colors for visual effect. For example, with respect to the reindeer sculpture 38, the light strings 80 wrapped around the antlers of the ear and antler components 34*e* may be of a yellow or golden hue, while the remaining light strings 80 that comprise the wrapping 82 are uncolored or substantially clear. As the light from the lighting elements 92 are transmitted through the electrical insulation and refracted, scattered, or reflected along the length of the light string, the light is partially filtered by the hued electrical insulation to take on a color that is biased toward the hued color. It is contemplated that other color schemes components 34 could be implemented, and for other lighted decorative sculptures 30. For example, green coloring for portions of a leprechaun sculpture, red coloring for portions of a Santa Clause sculpture, and so on.

Alternative or in addition to hued colors for the translucent material of the electrical insulation 88, the electrical conductors 87 may have a surface that are of different colors, for example by a tinning process. In the example of the antlers of the reindeer sculpture 38, the electrical conductors 87 of the light strings 80 that wrap the antlers may have a gold-colored surface while the electrical conductors 87 of the remaining light strings 80 have a silver-colored surface. Light reflected from the electrical conductors 87 are effectively filtered in accordance with the surface color of the electrical conductors 87. For light strings where the surface color of the electrical conductors 87 and the hue of the electrical insulation 88 are the same, the accent of the component 34 may be enhanced. For light strings where the surface color of the electrical conductors 87 is colored and the electrical insulation 88 remains substantially clear, the accent of the component 34 may be muted.

The combination of colored reflected light from the electrical conductors 87 and the hued refracted and scattered light from the electrical insulation 88 can also be blended for unique coloring effect. For example, electrical conductors 88 having a red colored surface that are clad in electrical insulation 88 that is of a blue-colored hue may take on a purple color effect. Furthermore, where "smart lights" (described above) are implemented, the color of the light emitted from the lighting elements 92 can also be colored for unique accenting and blending effect. Consider a leprechaun sculpture (not depicted) having a hat and vest, shamrock, and a pot of gold. The hat and vest could feature green colored electrical conductors 87 or green hued electrical insulation 88, while the shamrock includes both green colored electrical conductors 87 and green hued electrical insulation 88. Furthermore, the light string 80 of the hat and vest could implement white light while the shamrock implements "smart light" lighting elements 92 that switch or fade between white and green light. Such an arrangement would tend to accent the green of the shamrock over the green of the hat and vest, with the varying of the color of the lighting elements 92 of the shamrock causing a variation of the accent. Similarly, the pot of gold component of the leprechaun sculpture could include light strings 80 having gold colored electrical conductors 87, yellow- or gold-hued electrical insulation 88, and "smart light" lighting elements 92 that switch or fade between white and yellow light. The switching or fading of the "smart lights" of the respective light strings 80 of the shamrock and the pot of gold may be timed so that they are accented at the same time, at alternate times, or both over the course of a programmed time interval. Similar lighting schemes are contemplated for accenting, for example, the star of a lighted magi sculpture set, the halo of an angel, the infant of a manger scene, and so on.

The absence of an outer layer over the sculpture frame, as well as the translucent property of the light strings 80, enables an observer to view into and through the illuminated hollows 88 of the sculpture. The resulting lighting effect is unique, as best seen in FIG. 1. The lighted decorative sculptures 30 of FIG. 1 take on an overall translucent or ghost-like appearance, as evidenced by the ability to view through the lighted decorative sculpture 30 in the foreground to view portions of the lighted decorative sculpture 30 immediately behind.

The number of lighting elements 92 per light string 80 may be limited so that dimming of the lighting elements 92 due to resistance losses are limited. In some embodiments, the number of lighting elements 92 on a given light string 80 is 70 or less; in some embodiments, the number of lighting elements 92 on a given light string 80 is 60 or less; in some embodiments, the number of lighting elements 92 on a given light string 80 is 50 or less; in some embodiments, the number of light elements 92 on a given light string 80 is 40 or less.

Also, limiting the number of lighting elements 92 for the light strings 80 in accordance with the ranges stated above limits resistance loss of the light strings 80. Such resistance losses can cause the lighting elements 92 of a given light string 80 to become dimmed. We have found that by limiting the number of lighting elements 92 to 45 elements or less, the dimming due to resistance loss is not noticeable for LED lighting elements 92. By limiting the number of lighting elements 92 to 50, 60, or 70 lighting elements 92 or less, the dimming due to resistance loss may be noticeable but marginal.

The limited number of lighting elements per light string 80 may also provide for more manageable lengths of the light string 80 for manufacturing and assembly purposes. Consider a main power circuit 70 that is connected to thirty light strings 80 with nominally 2.5 cm (approximately 1 inch) spacing between the lighting elements 92. For a light string 80 having 40 lighting elements 92, the overall length is about 100 cm (approximately 40 inches). Such lengths for the light strings 80 are quite manageable for the wrapping operation of the lighted decorative sculpture 30. Compare this with certain conventional lighting techniques where all of the lights are on a single string. Such single light string would be 30 meters long (approximately 100 ft.), and manifestly more difficult to manage in the wrapping operation than the 100 cm lengths provided by the example light strings 80 described. Further, the use of limited lengths of wire of the light strings 80 can assist in preventing unwanted voltage drops which can result in those lighting elements 92 furthest from the voltage source, i.e., power circuit 70, being dimmer than those lighting elements 92 that are closer to the power circuit 70. In some embodiments, each of the plurality of light strings 80 has a length in a range of 50 cm to 200 cm inclusive; in some embodiments, each of the plurality of light strings 80 has a length in a range of 50 cm to 150 cm inclusive; in some embodiments, each of the plurality of light strings 80 has a length in a range of 75 cm to 125 cm inclusive.

In some embodiments, the plurality of light strings 80 for each of the plurality of detachable sections 32 each include insulated wires with electrical conductors of a first gauge and the main power circuit 70 includes electrical conductors of a second gauge, the first gauge number being larger than the second gauge number (larger gauge number indicating smaller diameter wire). In some embodiments, the first gauge is in a range of 24 AWG to 30 AWG inclusive, and the second gauge is in a range of 18 AWG to 22 AWG inclusive. Herein, a range that is said to be "inclusive" includes the end points of the stated range and any value therebetween.

Figures 9A, 9B, 10A, 10B:
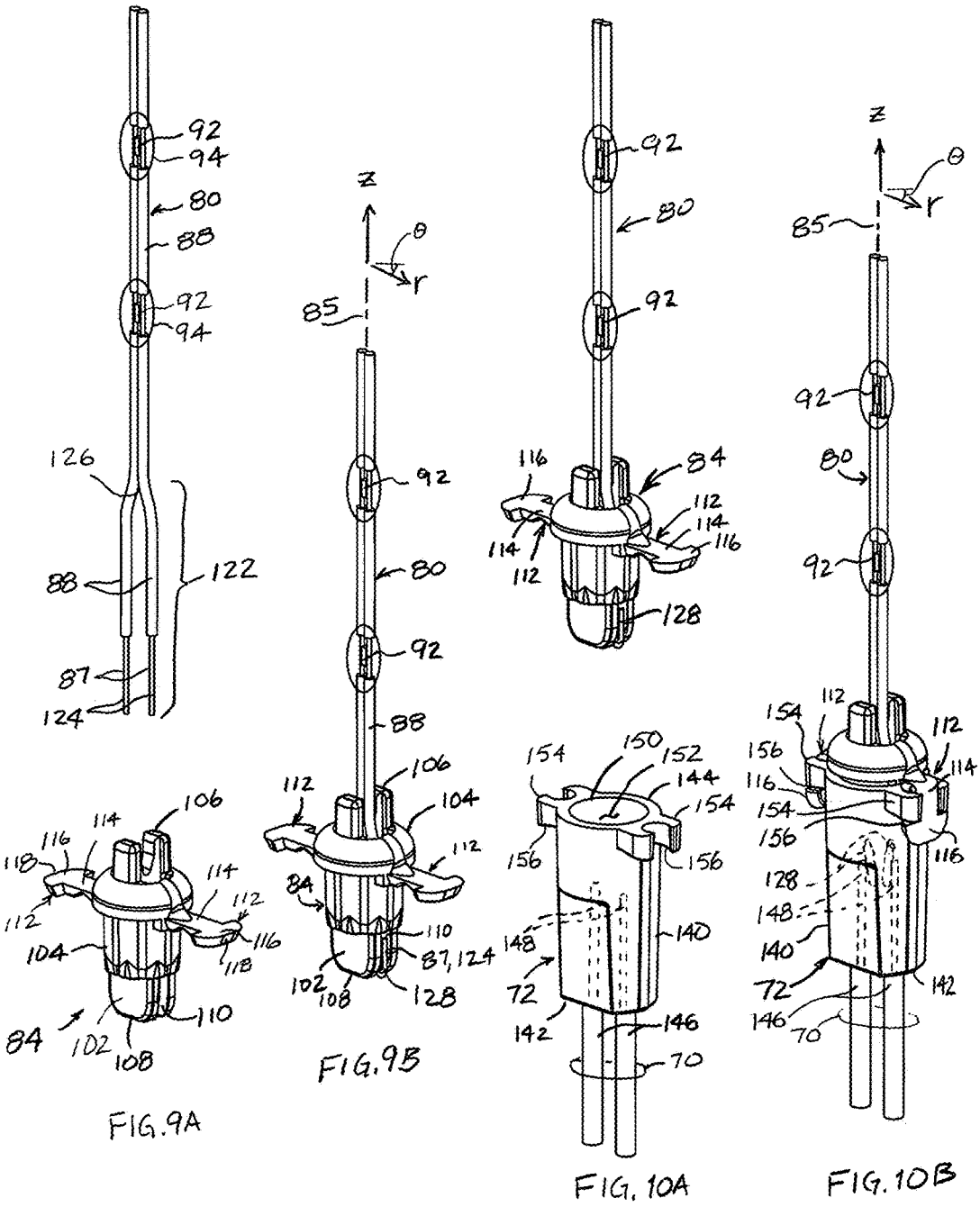
FIGS. 9A and 9B depict assembly of a light string and a connector plug according to an embodiment of the disclosure.
FIGS. 10A and 10B depict coupling of the plug of FIG. 9A to a receptacle of the main power circuit of FIGS. 4 and 7 according to an embodiment of the disclosure.

Referring to FIGS. 9A and 9B, the plug 84 and light string 80 are depicted in assembly in an embodiment of the disclosure. The plug 84 includes a core portion 102 surrounded by a sleeve portion 104. The core portion 102 includes an axially proximal end 106 and an axially distal end 108. The core and sleeve portions 102 and 104 are dimensioned so that the axially distal end 108 of the core portion 102 extends out of the sleeve portion 104. The core portion 102 may also define a pair of diametrically opposed channels 110, one of which is in view in FIG. 9A. A pair of flexible arms 112 extend radially from the sleeve portion 104, the flexible arms 112 being diametrically opposed. Each of the flexible arms 112 include a narrow portion 114 and a wide portion 116, the wide portion 116 being at a radially distal end 118 of the flexible arm 112.

To clarify the definition of "axially" and "radially," a right-cylindrical coordinate system 120 having r-θ-z coordinates is depicted in FIGS. 9B and 10B. The z-coordinate is aligned with the central axis 85, so that the r-coordinate locally extends perpendicular to the central axis 85. The angular orientation about the z-coordinate is defined by the θ-coordinate. Accordingly, "axially" refers to a direction parallel to the central axis 85 (z-coordinate) and "radially" refers to a direction perpendicular to the central axis 85 (r-coordinate).

To connect the plug 84 to the light string 80, end portions 122 of the pair of electrical wires or conductors 87 are separated and include exposed portions 124 at one end of the light string 80, for example by stripping away the electrical insulation 88 (FIG. 9A). The separation of the electrical conductors 87 defines an apex 126 between the electrical conductors 87 and the electrical insulation 88. The pair of end portions 122 are routed over opposing sides of the core portion 102 and through the sleeve portion 104, so that the apex 126 is near or in contact with the axially proximal end 106 of the core portion 102 and the exposed portions 124 of the end portions 122 extend beyond the axially distal end 108 of the core portion 102. The exposed portions 124 that extend beyond the core portion 102 are then bent away from each other, so that each exposed portion 124 is disposed within the respective opposed channel 110 along respective and opposing sides of the core portion 102 (FIG. 9B). In the depicted embodiment, the bent exposed portions 124 of the end portions 122 extend along the same sides of the plug 84 as the flexible arms 112.

Functionally, the exposed portions 124 of the end portions 122 serve as electrical contacts 128 for the light string 89 and plug 84 in assembly. The plug 84 is captured by the light string 80 between the apex 126 and the bent exposed portions 124.

Referring to FIGS. 10A and 10B, coupling and securing of the plug 84 to the receptacle 72 is depicted in an embodiment of the disclosure. The receptacle 72 includes a housing 140 having a first end 142 and a second end 144. The main power circuit 70 is routed through the first end 142 to form leads 146 that extend into the housing 140 to form two contacts 148 (depicted in phantom). The housing defines an opening 150 at the second end 144 which accesses a cavity 152. The cavity 152 may be generally rectangular proximate the first end 142, transitioning to a circular geometry proximate the opening 150. In the depicted embodiment, a pair of clips 154 extend radially outward proximate the first end 142 of the housing 140, the clips 154 being diametrically opposed and defining a proximal face 156. In the depicted embodiment, the clips 154 are coplanar with the leads 146 and contacts 148.

The plug 84, attached to the light string 80 as described above attendant to FIGS. 9A and 9B, is alighted with the receptacle 72 and rotationally oriented so that the flexible arms 112 are coplanar with the clips 154 (FIG. 10A). Such rotational orientation also aligns the electrical contacts 128 of the plug with the electrical contacts 148 of the receptacle 72. The plug 84 is then inserted into the receptacle 72, so that the electrical contacts 128 of the plug are brought into contact with the electrical contacts 148 of the receptacle 72. The flexible arms 112 are folded over the receptacle 72 so that the narrow portions 114 of the flexible arms 112 snap into the clips 154, and the wide portions 116 engage the proximal face 156 of the clips 154.

Functionally, engagement of the electrical contacts 128 of the plug 84 with the electrical contacts 148 of the receptacle 72 connects the light string 80 with the main power circuit 70. Engagement of the wide portions 116 with the proximal faces 156 of the clips 154 secures the plug 84 within the receptacle 72 to maintain contact between the electrical contacts 128 and 148. The snapping of the narrow portions 114 of the flexible arms 112 into the clips 154 holds the flexible arms 112 within the clips 154 so that the wide portions 116 remain engaged with the proximal faces 156 of the clips 154.

Alternative embodiments of receptacles 72 and corresponding plugs 84 are disclosed in U.S. Provisional Patent Application No. 62/572,437 (the '437 Application), filed Oct. 14, 2017, now utility application number commonly owned by the assignee of the present application, and the embodiments of connectors, such as receptacles and plugs, connecting light strings to a main power circuit as described in the Detailed Description of the '437 Application and as depicted in FIGS. 1 and 15-23, and which is herein incorporated by reference.

Figures 11A, 11B, 11C, 11D:
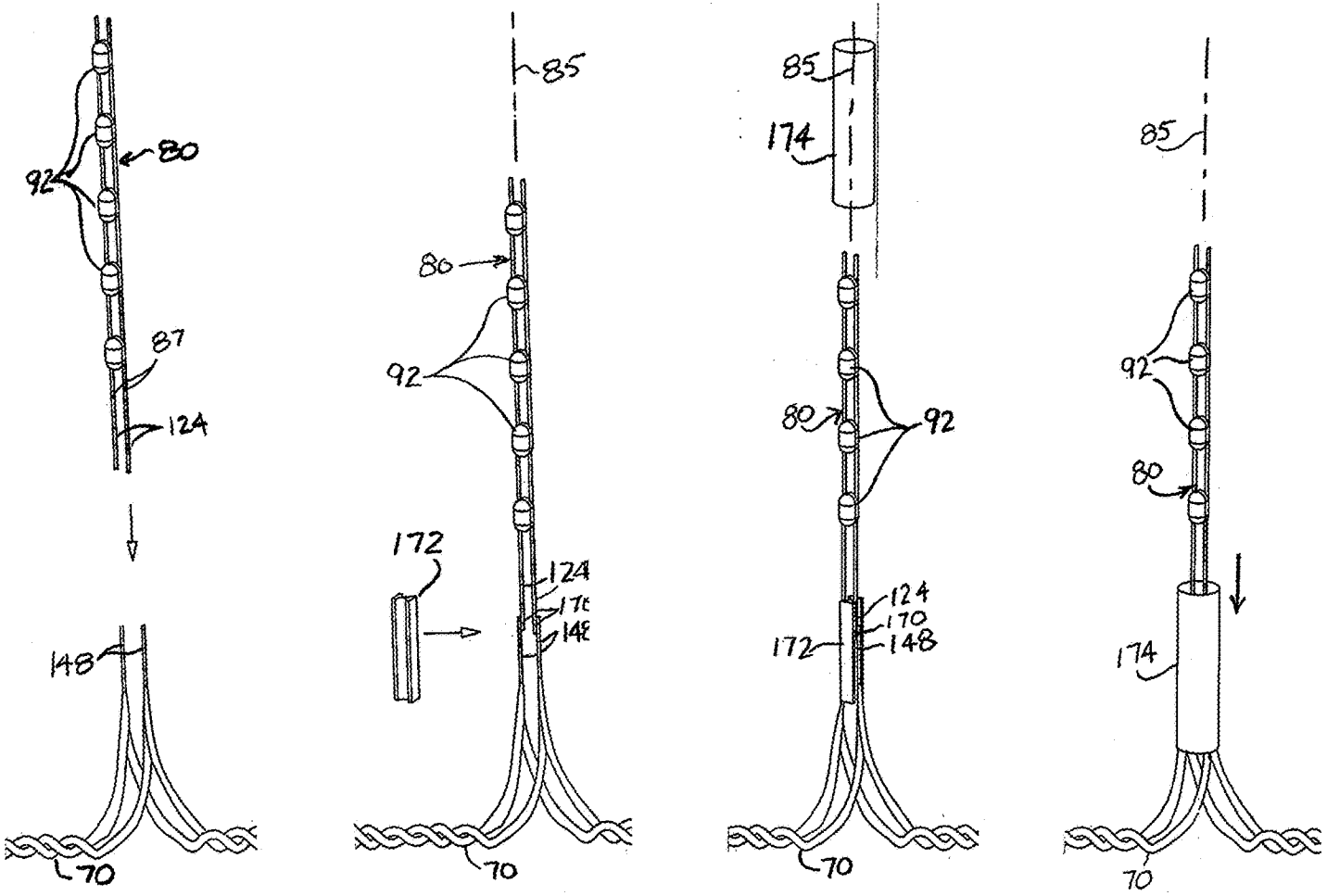
FIGS. 11A through 11D depict assembly of a light string to a main power circuit without use of detachable connectors according to an embodiment of the disclosure.

Referring to FIGS. 11A through 11D, an alternative, connector-less connection between the light strings 80 and the power circuit 70 is depicted in an embodiment of the disclosure. As with the connector 86 of FIGS. 9A through 10B, the light string 80 is configured with the pair of exposed portions 124 of the electrical conductors 87, and portions of the main power circuit 70 are exposed to define the pair of electrical contacts 148, but without the presence of a plug or receptacle. The pair of exposed portions 124 of the electrical conductors 87 are brought into engagement with the pair of electrical contacts 148 of the power circuit 70 (FIGS. 11A and 11B) to define a pair of contact junctions 170. A dielectric spacer 172 is disposed between the exposed contact junctions 170 (FIGS. 11B and 11C). A dielectric sleeve 174 is then disposed over and secured about the dielectric spacer 172, the exposed portions 124, the exposed electrical contacts 148, and the contact junctions 170 (FIGS. 11C and 11D).

In the depicted embodiment, the dielectric sleeve 174 is depicted as being slid over the light string 80, an approach that is made practical by the shortened length of the light strings 80 relative to conventional light strings. The dielectric sleeve 174 may be, for example, a shrink fit tube having a diameter large enough to pass over the light string 80 in pre-shrunk form, and which wraps tightly about the dielectric spacer 172, exposed portions 124, exposed electrical contacts 148, and contact junctions 170 upon application of heat. However, the passage of the dielectric sleeve 174 over the light string 80 is not limiting. The area about the dielectric spacer 172 and contact junctions 170 may be isolated and secured in other ways, for example, by wrapping with a dielectric material (e.g., electrical tape), fitting with a split or clamshell sleeve over the area from a lateral approach, or by casting or coating the area with a dielectric potting.

Functionally, the dielectric spacer 172 isolates the pairs of exposed portions 124, exposed electrical contacts 148, and contact junctions 170 from contact with each other. The dielectric sleeve 174 captures the dielectric spacer 172 and secures the exposed portions 124 and the exposed electrical contacts 148 in place against the dielectric spacer 172. This maintains the electrical connection provided by the contact junctions 170 while also isolating the portions 124, electrical contacts 148, and contact junctions 170 from the environment and contact with external artifacts.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A lighted decorative sculpture for producing a lighting effect, comprising:

a sculpture framework comprising a first framework section connectable to a second framework section, a first plurality of light string assemblies coupled to the first framework section, each of the first plurality of light string assemblies defining a first central axis, and comprising:

a first continuous conductor defining a first wire gauge;

a second continuous conductor, the second continuous conductor arranged in parallel with the first continuous conductor;

a translucent insulative material on the first continuous conductor and the second continuous conductor;

a first plurality of lighting elements electrically connected to the first continuous conductor and the second continuous conductor such that each of the plurality of lighting elements is electrically connected to one another in an electrically parallel configuration, each lighting element comprising a light-emitting diode (LED) encapsulated by a translucent material and oriented to direct light axially through the encapsulating translucent material and toward the translucent insulative material for transmission of the light into the translucent insulated material; and a light-string electrical connector connected to an end of the first continuous conductor and to an end of the second continuous conductor;

a second plurality of light strings coupled to the second framework section, a main power circuit for providing power to the first plurality of light strings and the second plurality of light strings, the main power circuit comprising a power plug for connecting to an external power source, a set of power wires, and a plurality of power-plug electrical connectors, each of the power-plug electrical connectors electrically connected to the light-string electrical connectors of the first plurality of light strings such that the main power circuit is in electrical connection with each of the light strings of the first plurality of light strings, wherein each power wire of the set of power wires defines a power-wire gauge, the power-wire gauge indicating a power-wire diameter that is larger than a wire diameter indicated by the first wire gauge.

2. The lighted decorative sculpture of claim 1, wherein the first wire gauge is in a range of 24 AWG to 30 AWG, inclusive, the power-wire gauge is a range of 18 AWG to 22 AWG, inclusive.

3. The lighted decorative sculpture of claim 1, wherein the first wire gauge is in a range of 24 AWG to 30 AWG, inclusive, the power-wire gauge is a range of 18 AWG to 22 AWG, inclusive, and each of the plurality of first light string assemblies has a length in a range of 50 cm to 150 cm, inclusive, thereby minimizing voltage drop along the length of each of the plurality of first light string assemblies.

4. The lighted decorative sculpture of claim 1, wherein each of the plurality of first light string assemblies has a length in a range of 50 cm to 150 cm, inclusive, and includes a maximum of 60 lighting elements, thereby minimizing voltage drop along the length of each of the plurality of first light string assemblies and maximizing uniformity of lighting element brightness.

5. The lighted decorative sculpture of claim 1, wherein the plurality of first light string assemblies comprise a first group of light string assemblies and a second group of light string assemblies, each light string assembly of the first group of light string assemblies electrically connected to the other in parallel, each light string assembly of the second group of light string assemblies electrically connected to the other in parallel, and the first group of light string assemblies electrically connected to the second group of light string assemblies in series.

6. The lighted decorative sculpture of claim 1, wherein the translucent insulative material of comprises polyvinyl chloride and the framework comprises metal.

7. The lighted decorative sculpture of claim 1, wherein the first framework section includes a plurality of rods and a plurality of protrusions extending transversely from the plurality of rods, and portions of the plurality of first light strings are wrapped about the plurality of protrusions, thereby securing the plurality of first light strings to the first framework section.

8. The lighted decorative sculpture of claim 7, wherein the plurality of protrusions comprise a plurality of open loops.

9. The lighted decorative sculpture of claim 1, wherein the main power circuit includes a first power-circuit section connected to the first framework section and a second power-circuit section connected to the second framework section, the first power-circuit section and the second power circuit section configured to be removably connectable to each other via a power-circuit electrical connector, such that the first framework section with the first plurality of light strings and first power-circuit section can be mechanically decoupled from the second framework section with the second plurality of light strings and second power-circuit section for convenient storage.

10. The lighted decorative sculpture of claim 9, wherein the first power-circuit section includes an excess-wire portion connected to the power-circuit electrical connector.

11. The lighted decorative sculpture of claim 1, wherein the plurality of light strings comprise a first group of light strings and a second group of light strings, each light string of the first group of light strings electrically connected to one another in parallel, each light string of the second group of light strings electrically connected to one another in parallel, and the first group of light strings electrically connected to the second group of light strings in series.

12. The lighted decorative sculpture of claim 1, wherein the main power circuit includes a first power-circuit section connected to one of the plurality of detachable sections and a second power-circuit section connected to another of the plurality of detachable sections, the first power-circuit section and the second power circuit section configured to be removably connectable to each other via a power-circuit electrical connector, such that plurality of detachable sections can be mechanically decoupled and electrically disconnected from each other for convenient storage.

* * * * *